US008124719B2

(12) United States Patent
Sawa

(10) Patent No.: US 8,124,719 B2
(45) Date of Patent: Feb. 28, 2012

(54) FURAN RESIN COMPOSITION FOR PRODUCTION OF MOLDS

(75) Inventor: Masuo Sawa, Wakayama (JP)

(73) Assignee: KAO Corporation, Tokyo (JP)

( * ) Notice: Subject to any disclaimer, the term of this patent is extended or adjusted under 35 U.S.C. 154(b) by 768 days.

(21) Appl. No.: 11/631,938

(22) PCT Filed: Aug. 4, 2005

(86) PCT No.: PCT/JP2005/014702

§ 371 (c)(1),
(2), (4) Date: Aug. 10, 2007

(87) PCT Pub. No.: WO2006/014017

PCT Pub. Date: Feb. 9, 2006

(65) Prior Publication Data

US 2008/0045692 A1 Feb. 21, 2008

(30) Foreign Application Priority Data

Aug. 6, 2004 (JP) ..... 2004-230310

(51) Int. Cl.
*C08G 65/34* (2006.01)
*C08G 65/00* (2006.01)

(52) U.S. Cl. ..... 528/417; 528/403

(58) Field of Classification Search ..... 528/417, 528/403

See application file for complete search history.

(56) References Cited

U.S. PATENT DOCUMENTS

| | | | |
|---|---|---|---|
| 4,271,054 | A | 6/1981 | Kim |
| 4,273,693 | A | 6/1981 | Kim |

FOREIGN PATENT DOCUMENTS

| | | | |
|---|---|---|---|
| JP | 51-26122 | | 8/1976 |
| JP | 54-46126 | A | 4/1979 |
| JP | 55-18408 | A | 2/1980 |
| JP | 57-88943 | A | 6/1982 |
| JP | 3-94952 | A | 4/1991 |
| JP | 4-371343 | A | 12/1992 |
| JP | 6-297072 | A | 10/1994 |
| JP | 8-57577 | A | 3/1996 |
| JP | 9-47840 | A | 2/1997 |
| JP | 2000-225437 | A | 8/2000 |

OTHER PUBLICATIONS

Igata Zokeiho, (Foundry Molding Method), 4th Ed., pp. 134-135, Nov. 18, 1996, Japanese Association of Casting Technology (JACT).

Japanese Office Action for corresponding JP Applicaiton No. 2005-208586 mailed on Feb. 15, 2011 with its English translation.

*Primary Examiner* — Duc Truong

(74) *Attorney, Agent, or Firm* — Birch, Stewart, Kolasch & Birch, LLP

(57) ABSTRACT

A furan resin composition for production of molds has a urea content of 1 to 10 wt-% and a pH value (25° C.) of 7 to 10.

10 Claims, No Drawings

FURAN RESIN COMPOSITION FOR PRODUCTION OF MOLDS

TECHNICAL FIELD

The present invention relates to a furan resin composition used for addition to a refractory granular material in order to produce a mold.

PRIOR ARTS

A self-curing mold is produced by adding an acid-curing resin such as furfuryl alcohol and a hardener such as phosphoric acid or benzene sulfonic acid to a refractory granular material such as silica sand, then mulling the resulting mixture, charging the resulting mulled sand into a wooden pattern, and curing the resin. However, the curing rate of the resin based on furfuryl alcohol is hardly regulated, and there is a tendency toward a reduction in mold strength, and for improving this, urea/formaldehyde modified furan resin having urea co-condensed therein is generally used ("Igata Zokeiho" (Foundry Molding Method), $4^{th}$ ed., pp. 134-135, Nov. 18 (1996), Japanese Association of Casting Technology (JACT)).

For further improving the curing properties of a binder composition containing an acid-curing resin, various measures have been proposed. For example, JP-B 51-26122 discloses a sand binder for casting using furfuryl alcohol in combination with a composition prepared by reacting urea, glyoxal and formaldehyde in a specific ratio. JP-A 54-46126 discloses a sand binder composition for casting comprising an acid-curing compound, a phenol derivative and water in a specific ratio. JP-A 6-297072 discloses that a specific curing accelerator is contained in a binder composition for production of molds which is based on an acid-curing resin. JP-A 8-57577 discloses that a specific curing accelerator is contained in a binder composition for production of molds which is obtained by incorporating furfuryl alcohol as a major component.

SUMMARY OF THE INVENTION

The present invention relates to a furan resin composition for production of molds, which has a urea content of 1 to 10 wt-% and a pH value (25° C.) of 7 to 10.

The present invention also relates to a binder for production of molds, which comprises the furan resin composition for production of molds according to the present invention.

Further, the present invention relates to a binder for production of molds, which comprises the furan resin composition for production of molds according to the present invention and at least one curing accelerator selected from the group consisting of a compound represented by the following general formula (1) and a phenol derivative having a substituent group increasing the charge density in the ortho- or para-position relative to a hydroxyl group of the phenol, as well as a method of producing molds comprising use of the binder for production of molds.

(1)

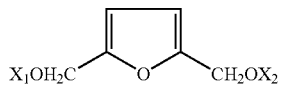

wherein $X_1$ and $X_2$ each represent a hydrogen atom, $CH_3$ or $C_2H_5$.

The invention provides use of the above shown furan resin composition as a binder for production of molds.

DETAILED EXPLANATION OF THE INVENTION

In the prior arts, the furan resin used as a binder for a self-curing mold is obtained usually by co-condensation of urea or formaldehyde with furfuryl alcohol, and from the viewpoint of improving working atmosphere during mold production (during resin curing), there is a desire for reduction in the concentration of formaldehyde in the product. For this purpose, it is conceivable to reduce the concentration of formaldehyde in furan resin by removing unreacted formaldehyde in a process of producing the resin, but this makes the process complicated and cannot be said to be industrially appropriate. Incorporation of formaldehyde scavengers such as urea and resorcinol is conceivable, but these compounds are poor in solubility and stability to generate turbidity and precipitation in the resin composition, thus suffering from a disadvantage of failure to achieve stable supply in a production line. It follows that in the furan resin for mold production, combined use of urea is desirable from the viewpoint of capturing formaldehyde, but is problematic in respect of stability.

The present invention provides a furan resin composition for mold production obtained from furfuryl alcohol as a major component, which can suppress turbidity and precipitation in the resin composition and is excellent in curing properties even if urea is contained for improving working atmosphere (particularly for reducing formaldehyde generated during molding).

According to the present invention, there is obtained a furan resin composition for mold production, which is excellent in solubility of urea, suppresses turbidity and precipitation and is excellent in working atmosphere (particularly for reduction in formaldehyde generated during molding).

When a specific curing accelerator is further used in the furan resin composition for production of molds according to the present invention, there can be obtained a binder for production of molds, which is excellent in solubility of urea without deteriorating curing properties such as mold strength, curing rate etc.

The invention improve the solubility and stability of urea in a furan resin composition for mold production using urea to reduce the formaldehyde concentration and improve the working environment.

The furan resin composition for production of molds according to the present invention is obtained by polycondensation of furfuryl alcohol as a major component. As shown on page 135 etc. in "Igata Zokeiho" (Foundry Molding Method), $4^{th}$ ed., published in Nov. 18, 1996 by Japanese Association of Casting Technology (JACT), the furan resin composition is obtained for example by polycondensation of furfuryl alcohol, urea and an aldehyde as major components. As the aldehyde, conventional known aldehyde compounds such as formaldehyde, glyoxal and furfuryl can be used. In the present invention, formaldehyde is particularly preferably used. When furfuryl alcohol, urea and an aldehyde are polycondensed, the furan resin composition of the present invention is obtained as a mixture of a furfuryl alcohol condensate, a furfuryl alcohol/alkylol urea polycondensate, a urea/aldehyde condensate, a polycondensate produced by further polycondensation of the respective condensates, unreacted components, water etc., depending on the compounding ratio of the respective components.

The urea in the furan resin composition of the present invention is urea not having undergone any condensation reaction with formaldehyde or furfuryl alcohol, and may be either urea remaining as unreacted or a separately added urea. In the present invention, the content of urea in the furan resin composition is 1 to 10 wt %, preferably 1 to 5 wt %. It is more preferably 1 to 6 wt %, even more preferably 2 to 6 wt % or 1 to 4 wt %, even more preferably 2 to 4 wt. % from the viewpoint of prevention of defects of casting depending on material of a cast product. The urea in the furan resin composition can be measured by the following procedures of LC/MS analysis.

<LC/MS analysis conditions>

Column: TSK-gel Amido 80 (4.6 mmϕ×250 mm).

Mobile phase: acetonitrile/water=95/5 (isocratic).

Column oven; 40° C.

Flow rate: 1.0, mL/min (MS introduction split: ¼).

Detection: MSD (SIM), POSI detection; m/z, 60.1±10; resolution, 0.5 amu; DWELL TIME, 250 msec; ion source heater, 300° C.

Analysis time: 15 minutes.

Preparation of a sample: dilution with acetone/water=95/5.

The furan resin composition of the present invention has a PU value (25° C.) of 7 to 10, preferably 7.5 to 10, more preferably 8 to 10 to obtain a stable furan resin composition. By regulating the ph value in this range, the turbidity and precipitation of urea can be suppressed. The pH value (25° C.) is preferably 7 to 10, more preferably 7 to 9 in order to obtain a mold having an excellent strength. The pH value of the furan resin composition of the present invention is a value determined by measuring a mixture at 25° C. of the furan resin composition and water prepared in a weight ratio of 50/50 under stirring. Regulation of the pH can be conducted with an alkali such as potassium hydroxide or sodium hydroxide or an acid such as acetic acid or oxalic acid. Usually, the pH value of a urea/formaldehyde modified furan resin-based binder composition using urea is lower than 7.

The furan resin composition of the present invention is characterized by having a urea content of 1 to 10 wt % and a pH value (at 25° C.) of 7 to 10 thereby giving a furan resin composition for mold production excellent in working atmosphere and capable of suppressing the turbidity and precipitation of the resin composition. Although the reason that the effect of the present invention is demonstrated is not evident. It is considered that the effect of the present invention on suppression of the turbidity and precipitation of the furan resin composition is demonstrated because by regulating the pH (at 25° C.) of the furan resin composition in the range of 7 to 10, the solubility of urea in the furan resin composition is improved or the reaction of urea with the furan resin composition is suppressed thereby permitting the urea to occur stably in the resin composition, thus exhibiting the effect of the present invention.

The furan resin composition of the present invention can provide a binder for mold production containing the same. Further, the furan resin composition of the present invention can be used in combination with a hardener, to constitute a binder for mold production. When the furan resin composition of the present invention is used to produce a mold, a hardener such as a conventionally known phosphoric acid compound or a sulfonic acid compound can be used as the hardener for curing the resin composition. The content of the hardener in the binder is preferably 10 to 60 parts by weight, more preferably 15 to 40 parts by weight, based on 100 parts by weight of the furan resin composition.

As the phosphoric acid compound, use is made of phosphoric acid, condensed phosphoric acid, phosphates such as methyl phosphate and ethyl phosphate, and phosphates such as potassium phosphate and potassium hydrogen phosphate. As the sulfonic acid compound, use is made of aliphatic sulfonic acid such as methane sulfonic acid and ethane sulfonic acid, aromatic sulfonic acid such as benzene sulfonic acid, toluene sulfonic acid, xylene sulfonic acid and phenol sulfonic acid, and inorganic acids such as sulfuric acid.

The furan resin composition of the present invention can be used in combination with a hardener in order to serve as a binder, and can provide a binder for mold production not deteriorating curing properties such as mold strength and curing rate by further using at least one curing accelerator selected from the group consisting of a compound represented by the following general formula (1) [referred to hereinafter as curing accelerator (1)] and a phenol derivative having a substituent group increasing the charge density in the ortho- or para-position relative to a hydroxyl group [referred to hereinafter as curing accelerator (2)],

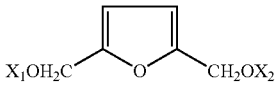

(1)

wherein $X_1$ and $X_2$ each represent a hydrogen atom, $CH_3$ or $C^2H_5$.

The curing accelerator (1) includes 2,5-bishydroxymethyl furan, 2,5-bismethoxymethyl furan, 2,5-bisethoxymethyl furan, 2-hydroxymethyl-5-methoxymethyl furan, 2-hydroxymethyl-5-ethoxymethyl furan, and 2-methoxymethyl-5-methoxymethyl furan. In particular, 2,5-bishydroxymethyl furan is preferably used. This is because 2,5-bishydroxymethyl furan is more highly reactive than 2,5-bismethoxymethyl furan or 2,5-bisethoxymethyl furan and accelerates the curing reaction of a binder comprising furfuryl alcohol polycondensed as a major component. The reason for the high reactivity of 2,5-bishydroxymethyl furan is that its hydroxy group constitutes to the curing reaction. From the viewpoint of an effect of improving the initial strength of a mold and the solubility of the curing accelerator (1) in the furan resin composition, the curing accelerator (1) is used preferably in an amount of 0.5 to 63.0 parts by weight, more preferably 1.8 to 50.0 parts by weight, further more preferably 2.5 to 50.0 parts by weight, even more preferably 3.0 to 40.0 parts by weight, based on 100 parts by weight of the furan resin composition of the present invention.

The curing accelerator (2) is a compound having a substituent group increasing the charge density in the ortho- or para-position relative to a hydroxyl group of phenol, and examples include resorcinol, cresol, hydroquinone, phloroglucinol, methylene bisphenol etc. In particular, resorcinol and phloroglucinol are preferable. From the viewpoint of an effect of improving the initial strength of a mold and the solubility of the curing accelerator (2) in a binder, the curing accelerator (2) is contained preferably in an amount of 1.5 to 25.0 parts by weight, more preferably 2.0 to 15.0 parts by weight, still more preferably 3.0 to 10.0 parts by weight, based on 100 parts by weight of the furan resin composition of the present invention.

Further, a binder constituted by incorporating the furan resin composition of the present invention, the specific curing accelerator described above and the hardener described above can be obtained. The content of the furan resin composition in the constituent components of the binder of the present invention is preferably 50 to 90 wt %, more preferably 60 to 85 wt %.

The respective components of the binder described above are admixed with a refractory granular material to give kneaded sand (sand composition for mold production). As the refractory granular material, it is possible to employ a conventionally known refractory granular material, for example new sand or reclaimed sand such as silica sand based on quartz, chromite sand, zircon sand, olivine sand, alumina sand, mullite sand and synthetic mullite sand. As the reclaimed sand, sand obtained by usual a mechanical attrition or calcine system is used, but sand reclaimed by the attrition system is preferable because it is produced in higher yield, is economically excellent and is generally used.

For obtaining the mulled sand (the sand composition for mold production), a silane coupling agent in addition to the binder of the present invention may be added for the purpose of further improving the strength of the resulting mold. The silane coupling agent includes, for example, γ-(2-amino)aminopropyl methyl dimethoxy silane, γ-aminopropyl trimethoxy silane, γ-aminopropyl triethoxy silane, γ-glycidoxy propyl trimethoxy silane etc. The silane coupling agent may be used after incorporation into the binder.

The sand composition for mold production obtained in this manner can be used to produce a mold by a general method of producing a self-curing mold. That is, the sand composition for mold production is charged into a predetermined wooden patterns, and the compounded and mulled furan resin composition for mold production, preferably used in combination with the specific curing accelerator described above, is cured by the action of a hardener or a curing composition, whereby a mold can be obtained. For mulling mod production, curing temperature etc., heating or cooling is not particularly required, and ambient temperature may be used.

Example

The present invention is described in more detail by reference to the Examples. The Examples illustrate the present invention and are not intended to limit the present invention.

Under the conditions of 25° C. and 50% RH, 0.4 part by weight of a hardener (sulfuric acid/m-xylene-4-sulfonic acid/water=4/26/70, ratio by weight) shown in Table 1 was added to 100 parts by weight of new sand of fremantle silica sand, and then 0.8 part by weight of a mixture of a furan resin composition and a curing accelerator shown in Table 1 was added thereto and mixed to give mulled sand which was then charged into a test piece frame to prepare a test piece in the form of a cylinder of 50 mm in diameter and 50 mm in height. The results of the compression strength (MPa) of the test piece, as determined after 30 minutes and after 24 hours by a method described in JIS Z 2604-1976 are shown in Table 1. When a step cone was formed and cast from a molding material FC-250 (S/M=3.5), the evaluation results of offensive smell (stimulation) during molding and casting and the results of visual observation of the outward appearances after 1-month storage at 35° C. (closed system), of the furan resin composition used in them binder are collectively shown in Table 1.

TABLE 1

| | | Binder | | | | | | | | | | |
|---|---|---|---|---|---|---|---|---|---|---|---|---|
| | | Furan resin composition | | | Curing accelator | | Hardener | Compression strength (MPa) | | Offensive smell | | Stability of |
| | | Furan resin (weight-%) | Urea (weight-%) | pH (25° C.) | Compound | Parts by weight | Parts by weight | After 30 minutes | After 24 hours | During molding | During casting | furan resin composition |
| Example | 1 | 97 | 3 | 9 | — | 0 | 50 | 0.17 | 2.88 | No stimulating smell | No stimulating smell | Absence of turbility and precipitation |
| | 2 | 97 | 3 | 9 | Bishydroxy methylfuran | 10 | 50 | 0.22 | 3.30 | No stimulating smell | No stimulating smell | Absence of turbility and precipitation |
| | 3 | 97 | 3 | 9 | Resorcinol | 5 | 50 | 0.25 | 3.34 | No stimulating smell | No stimulating smell | Absence of turbility and precipitation |
| | 4 | 98 | 2 | 7 | — | 0 | 50 | 0.20 | 3.12 | No stimulating smell | Weak stimulating smell | Absence of turbility and precipitation |
| | 5 | 98 | 2 | 7 | Bishydroxy methylfuran | 10 | 50 | 0.26 | 3.27 | No stimulating smell | Weak stimulating smell | Absence of turbility and precipitation |
| | 6 | 97 | 3 | 7 | — | 0 | 50 | 0.20 | 3.12 | No stimulating smell | No stimulating smell | No turbility, but a trace amount of precipitation |
| Comparative example | 1 | 99.9 | 0.1 | 5 | — | 0 | 50 | 0.22 | 3.19 | Strong stimulation | Slightly strong stimulation | Absence of turbility and precipitation |
| | 2 | 97 | 3 | 5 | — | 0 | 50 | 0.23 | 3.26 | No stimulating smell | No stimulating smell | Occuring of turbidity |

The weight parts of the curing accelerator and the hardener in the table refer to ratios relative to 100 parts by weight of the furan resin composition. The pH of the furan resin composition was regulated with potassium hydroxide and oxalic acid.

*Furan resin: 70.5 wt % furfuryl alcohol, 24.5 wt % furfuryl alcohol/urea/formaldehyde polycondensate, 4.0 wt % water, and 1.0 wt % components other than urea.

The invention claimed is:

1. A binder for production of molds, which comprises 50 to 90% by weight of the furan resin composition, the furan resin composition comprising furan resin and urea in the content of 1 to 4% by weight and having a pH value (25° C.) of 7 to 9, the furan resin composition being obtained by mixing 97 to 98 parts by weight of furan resin and 2 to 3 parts by weight of urea based on 100 parts by weight of the furan resin composition.

2. The binder for production of molds according to claim 1, which further comprises at least one curing accelerator selected from the group consisting of a compound represented by the following general formula (1) and a phenol derivative having a substituent group increasing the charge density in the ortho- or para-position relative to a hydroxyl group of the phenol, (1)

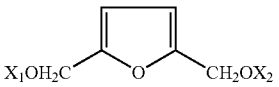

wherein $X_1$ and $X_2$ each represent a hydrogen atom, $CH_3$ or $C_2H_5$.

3. A method of producing molds, which comprises using the binder for production of molds according to claim 1 or 2.

4. The binder for production of molds according to claim 1, wherein said urea remaining as unreacted or a separately added urea is an urea not having undergone any condensation reaction with formaldehyde or furfuryl alcohol.

5. The binder for production of molds according to claim 1, wherein the binder contains 60 to 85% by weight of the furan resin composition.

6. The binder for production of molds according to claim 1, wherein the urea is an unreacted urea.

7. The binder for production of molds according to claim 1, wherein the pH range is 7.5 to 9.

8. The binder for production of molds according to claim 1, wherein the content of urea is 2 to 4% by weight.

9. The binder for production of molds according to claim 1, wherein the content of urea is 2 to 3% by weight.

10. The binder for production of molds according to claim 1, wherein the furan resin composition consists of the furan resin and the urea in the content of 1 to 4% by weight.

* * * * *